US005336974A

United States Patent [19]

Luijks et al.

[11] Patent Number: 5,336,974

[45] Date of Patent: Aug. 9, 1994

[54] HIGH-PRESSURE DISCHARGE LAMP

[75] Inventors: Gerardus M. J. F. Luijks; Hubertus A. M. Coenen, both of Eindhoven, Netherlands

[73] Assignee: U.S. Philips Corporation, New York, N.Y.

[21] Appl. No.: 988,621

[22] Filed: Dec. 10, 1992

[30] Foreign Application Priority Data

Dec. 23, 1991 [EP] European Pat. Off. ..... 91203377.6

[51] Int. Cl.[5] ..... H01J 7/44

[52] U.S. Cl. ..... 315/58; 315/73; 315/74; 315/289

[58] Field of Search ..... 315/50, 53, 58, 59, 315/60, 73, 45, 46, 51, 52, 56, 289, 74; 361/306, 328, 321 R; 338/20

[56] References Cited

U.S. PATENT DOCUMENTS

| | | | |
|---|---|---|---|
| 4,520,294 | 5/1985 | Iida et al. | 315/50 |
| 4,972,121 | 11/1990 | Iida et al. | 315/58 |
| 5,053,676 | 10/1991 | Luijks et al. | 315/58 |
| 5,138,231 | 8/1992 | Iida et al. | 315/73 |

FOREIGN PATENT DOCUMENTS

| | | |
|---|---|---|
| 0431696 | 6/1991 | European Pat. Off. . |
| 2623008 | 5/1989 | France . |
| 1294349 | 11/1989 | Japan . |
| 165553 | 6/1990 | Japan . |

*Primary Examiner*—Robert J. Pascal
*Assistant Examiner*—Arnold Kinkead
*Attorney, Agent, or Firm*—Brian J. Wieghaus

[57] ABSTRACT

The invention relates to a high-pressure discharge lamp including a discharge vessel and an outer envelope which encloses a space. The lamp has an igniter circuit which has a voltage-dependent capacitor and a resistor which are integrated so as to form a single component.

15 Claims, 1 Drawing Sheet

HIGH-PRESSURE DISCHARGE LAMP

BACKGROUND OF THE INVENTION

The invention relates to a high-pressure discharge lamp provided with a discharge vessel which is enclosed with intervening space by an outer envelope and which is provided with electrodes between which a discharge extends in the operational condition of the lamp, while each electrode is connected to a relevant current supply conductor, and provided with an igniter circuit which comprises a voltage-dependent capacitor and a resistor.

A lamp of the kind mentioned in the opening paragraph is known from JP-A-2-165553 (1990). In the known lamp, which is suitable for operation in series with a stabilizer ballast on an AC voltage supply source, the capacitor is arranged in the outer envelope. The known lamp comprises a bimetal switch in the electrical connection between the voltage-dependent capacitor and the current supply conductors. Heat generated by the lamp after ignition ensures in this case that the bimetal switch opens, so that the direct electrical connection is broken and the operation of the igniter circuit is thus ended.

It is attractive to arrange the capacitor in the outer envelope because of a comparatively simple lamp manufacturing method, inter alia because there is comparatively much space available there, in contrast to, for example, the lamp cap. Breaking of the electrical connection by the bimetal switch involves a risk of residual charge remaining on the capacitor. Without further precautions, this will lead to internal degeneration of the capacitor, resulting in short-circuit through the capacitor. The comparatively high temperature at which the capacitor is in the operational condition of the lamp plays a detrimental part here. To prevent this, a comparatively high-ohmic resistor is included in the igniter circuit so that residual charge can flow away from the capacitor.

A disadvantage of the known lamp is the use of an additional component in the form of the resistor in the igniter circuit. This raises the manufacturing cost both on account of a higher complexity of the manufacture and on account of a rise in the reject percentage during manufacture. A further disadvantage is that the use of the additional component seriously hampers an automation of lamp manufacture. This accordingly leads to a more expensive manufacturing method for the lamp.

SUMMARY OF THE INVENTION

The invention has for its object inter alia to provide a measure for counteracting the described disadvantage, while the igniter circuit is still mounted in the outer envelope.

According to the invention, this object is realised in a lamp of the kind mentioned in the opening paragraph in that the lamp is characterized in that the voltage-dependent capacitor and the resistor are integrated so as to form a single component.

By maintaining the direct electrical connection through the resistor in the operational condition of the lamp, it is achieved that any residual charge on the voltage-dependent capacitor can flow away through the discharge between the electrodes and/or through the supply source.

The use of an integral component reduces the number of components to be mounted, which implies a simplification of lamp manufacture. This also enhances the possibility of manufacturing by automatic mounting. The integration in addition achieves that the overall dimensions of the combined capacitor and resistor are reduced, which again results in a simplification of lamp manufacture.

The integral component may be constructed in the shape of a plate or of a disc. In an advantageous embodiment, the resistor is provided at one side of the component constructed as a plate or disc, on an insulating base surface, for example, by film technology.

Thermal screening of the capacitor is achieved in a simple manner in that the integral component thus formed is mounted with its side comprising the resistor facing the discharge vessel. Infrared radiation from the discharge vessel leads to strong heating of the starter circuit components, especially in the case of an evacuated outer envelope.

To counteract any risk of electric breakdown (so-called corona discharge) across the integral component and of reduction and evaporation of the integral component, this component may be mounted in a gas-filled ambience, preferably in a gas-filled gastight glass capsule. It is conceivable to fill the outer envelope itself with a suitable gas instead of using a separate capsule. An equivalent protection against the risk of corona discharge and against dissociation and/or evaporation of the integral component can be achieved by this. Owing to convection and conduction in the gas present in the outer bulb, heating of the integral component can be considerably reduced. The said convection and conduction lead to thermal losses and adversely affect the luminous efficacy of the lamp. For a large number of types of high-pressure discharge lamps, therefore, this is not a suitable solution.

Gas composition is so chosen that no corona discharge or reactions with components of the capacitor take place during lamp operation under the prevailing conditions. Suitable gases are $SF_6$, nitrogen, oxygen, and to a lesser degree rare gases. The gas filling may be formed by a single gas. Combinations of gases, however, are also possible.

A further advantage of the invention is that the use of the gas-filled gaslight glass capsule for mounting the integral component renders the measure according to the invention generally applicable to high-pressure discharge lamps.

A further improvement of the lamp can be achieved in that the gaslight glass capsule is provided with a radiation-reflecting layer. It is achieved by this in a simple but effective way that heating of the integral component, and thus of the capacitor in the operational condition of the lamp is considerably reduced. A further minimization of radiation on the integral component can be achieved in that the component is so positioned that the longitudinal axis of the discharge vessel lies substantially in a common plane with the component, which preferably has the shape of a plate or disc.

In a further embodiment of the lamp according to the invention, a voltage-dependent resistor is included in series with the capacitor. An advantage of this is on the one hand that the moment at which an ignition voltage pulse is generated can be favourably chosen through a suitable choice of the current-voltage characteristic of the resistor. On the other hand, the resistance character of the voltage-dependent resistor ensures that the level of the generated ignition voltage pulse is limited.

A further improvement is possible in that the ignition circuit is also provided with a fuse. It is achieved by this that an overload on the stabilizer ballast owing to excessively high currents is prevented through melting of the fuse even under unfavourable conditions such as a short-circuit in the capacitor.

The lamp according to the invention is particularly suitable as a replacement of a high-pressure mercury lamp. To improve the ignition behaviour of the lamp, the discharge vessel may be provided with an external ignition antenna which rests mainly against the discharge vessel at least in the non-operational condition of the lamp.

It may be desirable for an ohmic impedance to be present parallel to the capacitor also in conditions other than the operating condition. The use of a single component according to the present invention is an advantageous option in all these conditions. The ignition circuit of the lamp according to the invention may also comprise a voltage-dependent breakdown element such as, for example, a SIDAC.

BRIEF DESCRIPTION OF THE DRAWINGS

This and other aspects of the invention will be explained in more detail and described with reference to a drawing of an embodiment, in which.

DESCRIPTION OF THE PREFERRED EMBODIMENTS

Figure 1:
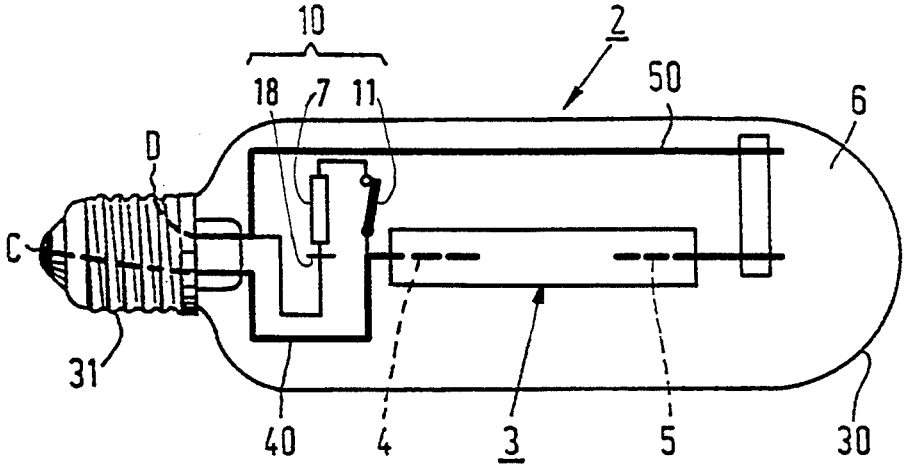
FIG. 1 shows a lamp in elevation.

In FIG. 1, a lamp 2 according to the invention is shown, provided with a discharge vessel 3 which is surrounded by an outer envelope 30, which encloses an evacuated space 6 and is fitted with a lamp cap 31, and provided with an igniter circuit 10 in which a voltage-dependent capacitor integrated with a resistor into a single component 18 is accommodated. The integral component 18 is mounted in the evacuated space 6 enclosed by the outer envelope 30. The discharge vessel 3 is provided with electrodes 4 and 5 between which a discharge extends in the operational condition of the lamp. Each electrode 4, 5 is connected to a relevant rigid current supply conductor 40, 50. Current supply conductor 40 is connected to a lamp connection point C of lamp cap 31. Similarly, current supply conductor 50 is connected to a lamp connection point D of lamp cap 31. The integral component 18 is mounted between the current supply conductors 40 and 50 with direct electrical contact.

The igniter circuit 10 is also provided with a fuse 7 and a bimetal switch 11.

Figure 2:
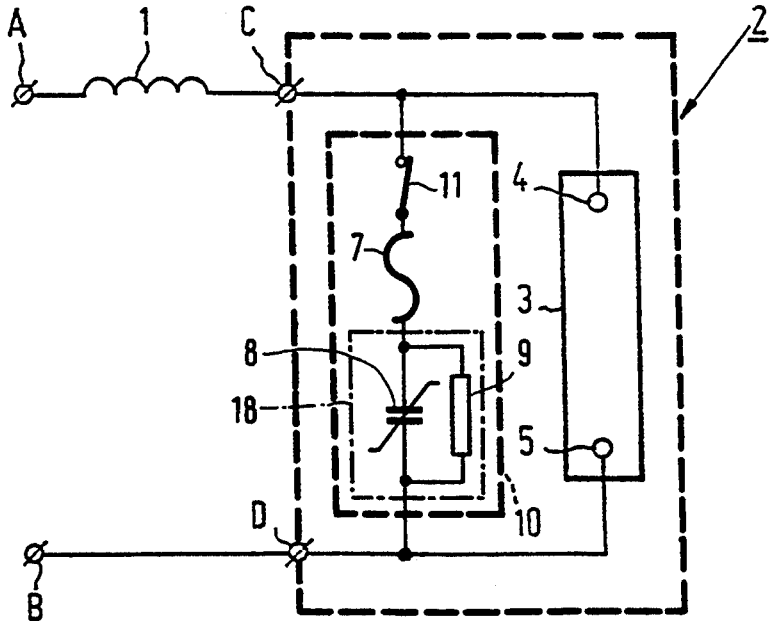
FIG. 2 is a diagram of a circuit formed by the lamp of FIG. 1 together with a stabilizer ballast.

In FIG. 2, parts corresponding to those in FIG. 1 are given corresponding reference numerals. The integral component 18 is built up from a voltage-dependent capacitor 8 and a high-ohmic resistor 9. A and B are connection points for an AC voltage supply source. Connection point A is connected to lamp connection point C via a stabilizer ballast 1. Connection point B is connected to lamp connection point D. In the igniter circuit 10, the chain comprising bimetal switch 11, fuse 7, and voltage-dependent capacitor 8 together with the stabilizer ballast generates ignition voltage pulses between the lamp connection points C and D, and thus between the lamp electrodes 4 and 5, in a known manner. When the lamp has ignited, the bimetal switch 11 will open owing to heat generation, so that further ignition pulse generation is effectively stopped. Any residual charge on the voltage-dependent capacitor can be drained off through resistor 9 to connection point B.

The discharge vessel 3 may be provided with an external auxiliary electrode as a further ignition aid.

The resistor 9 has a value of 1 MOhm for a practical lamp of the high-pressure sodium discharge lamp type with a power rating of 110 W and an evacuated outer envelope.

A resistor of this value, which can assume a temperature of more than 200° C. in the operational condition of the lamp, can be very well constructed as a ceramic resistor manufactured by the thick film technology on an insulating base. Preferably, the said resistor is integrated with a voltage-dependent capacitor, make TDK, for example of the NLB 1250 type.

The igniter circuit described is capable of generating ingition voltage pulses of approximately 1000 V, sufficient for igniting a high-pressure sodium discharge lamp quickly and reliably.

We claim:

1. A high pressure discharge lamp, comprising:

a) an outer lamp envelope;

b) a discharge device within said outer envelope which is energizeable for emitting radiation including visible light;

c) means for supporting said discharge device within said outer lamp envelope and for connecting said discharge device to a source of electric potential outside of said lamp envelope; and d) an igniter circuit within said outer lamp envelope electrically connected to said discharge device for igniting said discharge device, said igniter circuit comprising an integrated planar component comprising a planar, voltage dependent capacitor and a resistor electrically in parallel with said capacitor, said resistor being comprised by a ceramic substrate against said capacitor and a thick film resistive pattern on said substrate, said integrated component being arranged in said outer envelope with said thick film resistive pattern facing said discharge device and said capacitor facing away from said discharge device so that the radiation emitted by the discharge device impinges on the resistor and not directly on the capacitor.

2. A lamp as claimed in claim 1, characterized in that the integral component is mounted in a gas-filled gas-tight glass capsule.

3. A lamp as claimed in claim 2, characterized in that the igniter circuit includes a bimetal switch.

4. A lamp as claimed in claim 3, characterized in that the igniter circuit includes a fuse.

5. A lamp as claimed in claim 2, characterized in that the igniter circuit includes a fuse.

6. A lamp as claimed in claim 1, characterized in that the igniter circuit includes a fuse.

7. A lamp as claimed in claim 2, characterized in that the igniter circuit includes a bimetal switch.

8. A lamp as claimed in claim 7, characterized in that the igniter circuit includes a fuse.

9. A lamp as claimed in claim 1, characterized in that the igniter circuit includes a bimetal switch.

10. A lamp as claimed in claim 9, characterized in that the igniter circuit includes a fuse.

11. A high pressure discharge lamp, comprising:

a) an outer lamp envelope;

b) a discharge device within said outer envelope which is energizeable for emitting light, said discharge device being elongate and defining a longitudinal axis and emitting radiation substantially only in directions substantially transverse to said longitudinal axis;

c) means for supporting said discharge device within said outer lamp envelope and for connecting said discharge device to a source of electric potential outside of said lamp envelope; and d) an igniter circuit within said outer lamp envelope electrically connected to said discharge device for igniting said discharge device, said igniter circuit comprising an integrated planar component comprising a planar, voltage dependent capacitor and a resistor electrically in parallel with said capacitor, said resistor being comprised by a planar ceramic substrate against said capacitor and a thick film resistive pattern on said substrate, said integrated component having a minor circumferential face extending transverse to the planar substrate and opposing major faces extending therebetween, said integrated component being arranged in said outer envelope with said major faces substantially parallel to said longitudinal axis and said minor face transverse thereto for minimizing impingement of radiation from said discharge device on said integrated component.

12. A lamp as claimed in claim 11, characterized in that the igniter circuit includes a bimetal switch.

13. A lamp as claimed in claim 12, characterized in that the igniter circuit includes a fuse.

14. A lamp as claimed in claim 11, characterized in that the igniter circuit includes a fuse.

15. A high pressure discharge lamp according to claim 11, wherein the integrated planar component is mounted in a gas-filled gas-tight glass capsule.

* * * * *

UNITED STATES PATENT AND TRADEMARK OFFICE

CERTIFICATE OF CORRECTION

PATENT NO. : 5,336,974

DATED : August 9, 1994

INVENTOR(S) : Gerardus M. J. F. Luijks et al

It is certified that error appears in the above-indentified patent and that said Letters Patent is hereby corrected as shown below:

On the title page, item [54] and in column 1, line 2, after "LAMP" insert --HAVING A STARTING CIRCUIT WITH AND INTERGRATED PLANAR RESISTOR/CAPACITOR COMPONENT--.

Signed and Sealed this

First Day of November, 1994

*Attest:*

*Attesting Officer*

Bruce Lehman

BRUCE LEHMAN

*Commissioner of Patents and Trademarks*